US005641293A

United States Patent [19]

Tsuji et al.

[11] Patent Number: 5,641,293

[45] Date of Patent: Jun. 24, 1997

[54] CONNECTOR ENGAGEMENT DEVICE

[75] Inventors: Masanori Tsuji; Tamio Watanabe; Sakai Yagi, all of Shizuoka, Japan

[73] Assignee: Yazaki Corporation, Tokyo, Japan

[21] Appl. No.: 502,061

[22] Filed: Jul. 14, 1995

[30] Foreign Application Priority Data

Jul. 15, 1994 [JP] Japan ..... 6-164284

[51] Int. Cl.[6] ..... H01R 13/62

[52] U.S. Cl. ..... 439/157

[58] Field of Search ..... 439/153–160

[56] References Cited

U.S. PATENT DOCUMENTS 5,269,696 12/1993 Okada et al. ..... 439/160
5,330,362 7/1994 Ito et al. ..... 439/157
5,478,251 12/1995 Jaklin ..... 439/157
5,482,394 1/1996 Shinchi et al. ..... 439/157
5,509,816 4/1996 Katsuma ..... 439/157

FOREIGN PATENT DOCUMENTS 429179 3/1992 Japan ..... H01R 13/639

*Primary Examiner*—David L. Pirlot
*Assistant Examiner*—Brian J. Biggi
*Attorney, Agent, or Firm*—Sughrue, Mion, Zinn, Macpeak & Seas

[57] ABSTRACT

The set position of at least the fulcrum axis pins of an operation cam lever pivotally supported on a female connector or the projecting engagement pins of a male connector is biased by a predetermined bias quantity to the connecting operation initiating end side of the operation cam lever with respect to the connection-direction center line of the connection opening end portions of the respective connectors.

1 Claim, 4 Drawing Sheets

CONNECTOR ENGAGEMENT DEVICE

BACKGROUND OF THE INVENTION

The present invention relates to an improvement of a connector engagement device which is mainly used for mutual connection of connection terminal sets having a large number of connection terminals, such as a car wire harness, so that mutual connection/locking of a pair of female and male connectors is performed using a small insertion/removal force by leverage of an operation cam lever.

As a general connector engagement device for performing connection using a small insertion/removal force by using an operation cam lever, for example, there is a configuration as disclosed in Japanese Utility Model Unexamined Publication No. Hei. 4-29179. Hereupon, the outline of the conventional configuration and the state of the engaging operation are shown in FIGS. 5 through 8 successively.

In the configuration shown in each of FIGS. 5 through 8, the conventional connector engagement device for performing connection using a small insertion/removal force comprises a pair of female and male connectors 51 and 61, and an operation cam lever 71 rotatably mounted on the female connector 51.

More in detail, the female connector 51 receives a set of connection terminals (not shown) so as to face the connection opening end portion side in a housing portion 52 and has a fulcrum axis pin 53 formed so as to project on the connection end portion on each of two opposite sides (only one side is shown in the drawings) and at a predetermined position on the connection-direction center line s equivalent to a substantially middle portion of the effective overall width $w_1$ of the female connector 51.

Similarly to the female connector 51, the male connector 61 receives a set of connection terminals (not shown) to be connected to the set of connection terminals of the female connector 51 so that the set of connection terminals face the connection opening end portion side of a housing portion 62 and has an engagement pin 63 formed to project on each of two opposite sides (only one side is shown in the drawings) of the male connector 61 at the connection end portion side thereof so as to be located in a predetermined position on the common connection-direction center line s equivalent to the substantially middle portion of the effective overall width $w_2$ of the male connector 61.

Further, the operation cam lever 71 is rotatably pivotally supported on the female connector 51 so as to rise over the pair of fulcrum axis pins 53 on the opposite sides of the female connector 51. The operation cam lever 71 is provided with cam grooves 72 which are formed so that the engagement pins 63 can be pulled toward the female connector 51 side in the condition that the engagement pins 63 of the male connector 61 are received in the cam grooves 72 respectively of the cam operation lever 71.

Making the pivotal point of each fulcrum axis pin 53 of the female connector 51 a center, each of the cam grooves 72 of the operation cam lever 71 is composed of: a lead-in opening portion **72*a* which can receive, without any stress, a corresponding one of the engagement pins 63 of the male connector 61 in an open position of the operation cam lever 71; a guide cam groove portion 72*b* connected to the lead-in opening portion 72*a* and extended so as to gradually pull the engagement pin 63 toward the pivotal point; and a locking groove portion 72*c* connected to the guide cam groove portion 72*b* so as to lock and hold the engagement pin 63**.

Accordingly, in the case of the aforementioned conventional connector engagement device, when the set of connection terminals of the male connector 61 are first temporarily connected to the set of connection terminals of the female connector 51 by shallow insertion of the male connector 61 into the female connector 51 in a state (FIG. 5) in which the connection opening end portion of the male connector 61 is put so as to face the connection opening end portion of the female connector 51, the engagement pins 63 of the male connector 61 are led into the lead-in opening portions **72*a* of the operation cam lever 71 which are held in the open position in the state that the cam lever 71 is pivotally supported on the female connector 51 (FIG. 6**).

When the operation cam lever 71 on the female connector 51 side is then rotated around the pivot point of the fulcrum axis pins 53 in the direction to the engagement position as indicated by the arrow from the connecting operation initiating end a side to the connecting operation terminating end b side in the aforementioned condition, the engagement pins 63 of the male connector 61 led in the lead-in opening portions **72*a* of the operation cam lever 71 are guided by the guide cam grooves 72*b* which are formed so as to be made closer gradually to the pivot points, while the engagement pins 63 are in slide contact with the groove surfaces of the guide cam grooves 72*b* opposite to the fulcrum axis pins 53. As a result, the engagement pins 63 are pulled to the engagement position gradually by a relatively small rotational-direction operating force because of the leverage, around the pivot points, of the guide cam groove portions 72*b*, so that the set of connection terminals of the male connector 61 are connected gradually deeply to the set of connection terminals of the female connector 51. When the engagement pins 63 reach the respective terminal side of the guide cam groove portions 72*b*, the two sets of connection terminals are connected to each other (FIG. 7**).

When the rotating operation of the operation cam lever 71 is further continued, the engagement pins 63 are received respectively in the locking groove portions **72*c* to thereby lock the state of connection of the set of connection terminals of the male connector 61 in the set of connection terminals of the female connector 51. Thus, the complete connection is finished (FIG. 8). In this connection completion state, the engagement pins 63 of the male connector 61 are moved toward the female connector 51 side to a predetermined distance on the center line s in the direction of engagement and connection which passes through the pivot point of the female connector 51**, and held there.

Incidentally, the locked connection state can be unlocked easily by an operation reverse to the aforementioned operation.

In the aforementioned conventional connector engagement device, however, the pair of engagement pins 63 projected on the respective connection-direction center lines s on opposite sides of the male connector 61 are pulled toward the female connector 51 side through the rotational operation of the operation cam lever from the connecting operation initiating end a side to the connecting operation terminating end b side, by the pair of guide cam grooves **72*b* formed respectively in the opposite sides of the operation cam lever 71 which is mounted on the female connector 51 so as to be pivotally supported by the fulcrum axis pins 53 on the respective connection-direction center lines s so that the overall mutual connection of the set of connection terminals of the male connector 61 to the set of connection terminals of the female connector 51** is performed by a small insertion/removal force effected by the leverage. Thus, the following problems occur.

That is, when the state of connection of the set of connection terminals of the male connector 61 into the set of connection terminals of the female connector 51 is seen on the whole, the operation cam lever 71 becomes such that upon completion of the connecting operation, the connection operating force B of the operation cam lever 71 on the connecting operation terminating end b side is inevitably stronger than the connection operating force A on the connecting operation initiating end a side so that the connection operating forces have the relation A <B, by the operation force of the operation cam lever 71 given unilaterally from the connecting operation terminating end b side to the engagement pins 63 in the later stage of the connecting operation.

Accordingly, if the connection operating forces applied at the time of the mutual connection of the two sets of connection terminals of the female and male connectors 51 and 61 are in such a relation A <B so as to be unbalanced between the connecting operation initiating end a side and the connecting operation terminating end b side, the connecting operation initiating end a side subjected to the connection operating force A weaker than the connection operating force B is apt to be floated up in the direction of non-connection because of the connection operating force B given to the connection terminating end b side. Accordingly, the connecting operation initiating end a side is apt to become unstable, resulting in so-called oblique fitting in which the connection per se is not performed correctly along the connection-direction center lines s to thereby impede the smoothness of the operation. Consequently, there arises a problem that lowering of reliability of the mutual connection is brought about.

SUMMARY OF THE INVENTION

The present invention is provided upon such circumstances and an object of the present invention is to provide a connector engagement device in which the mutual connection of the sets of connection terminals of female and male connectors can be performed smoothly under predetermined connecting pressure uniform to all connection terminals and hence oblique fitting between the connectors is prevented from occurring.

In order to achieve the foregoing object, according to the present invention, a connector engagement device comprises: an operation cam lever mounted on a first connector, that is, one of male and female connectors, and rotatably pivotally supported on fulcrum axis pins formed on opposite sides of the first connector respectively, the operation cam lever having cam grooves of predetermined shapes formed in opposite sides thereof respectively; and engagement pins formed so as to project respectively on opposite sides of a second connector, that is, the other one of the female and male connectors, so that the engagement pins are engageable with the cam grooves respectively; whereby the engagement pins are pulled through the cam grooves toward the first connector side as the operation cam lever is operated to rotate from a connecting operation initiating end side to a connecting operation terminating end side of the operation cam lever to thereby perform mutual connection of a second set of connection terminals of the second connector to a first set of connection terminals of the first connector; wherein the set positions of the fulcrum axis pins for the operation cam lever pivotally supported by the first connector and/or the engagement pins formed so as to project on the second connector are biased by a predetermined bias quantity to the connecting operation initiating end side from the connection-direction center line of a connection end portion of each connector.

Preferably, in the above connector engagement device according to the present invention, the predetermined bias quantity is selected to be in a range of from 1/5 to 2/5 as large as the distance between the connection-direction center line and the connecting operation initiating end side.

Since the set positions of the fulcrum axis pins for the operation cam lever pivotally supported by the first connector and/or the engagement pins formed so as to project on the second connector are biased by a predetermined bias quantity to the connecting operation initiating end side from the connection-direction center lines, the connecting force due to the rotation of the operation cam lever from the connecting operation initiating end side to the connecting operation terminating end side acts uniformly or substantially uniformly during a period of from the connecting operation initiating point of time to the connecting operation terminating point of time. Accordingly, the set of connection terminals of the first connector and the set of connection terminals of the second connector are moved in parallel or substantially in parallel to each other along the connection-direction center line so as to be connected mutually, so that a stable connection state is obtained. That is, the oblique fitting of the connectors to each other is prevented from occurring.

DETAILED DESCRIPTION OF THE INVENTION

Figure 1:
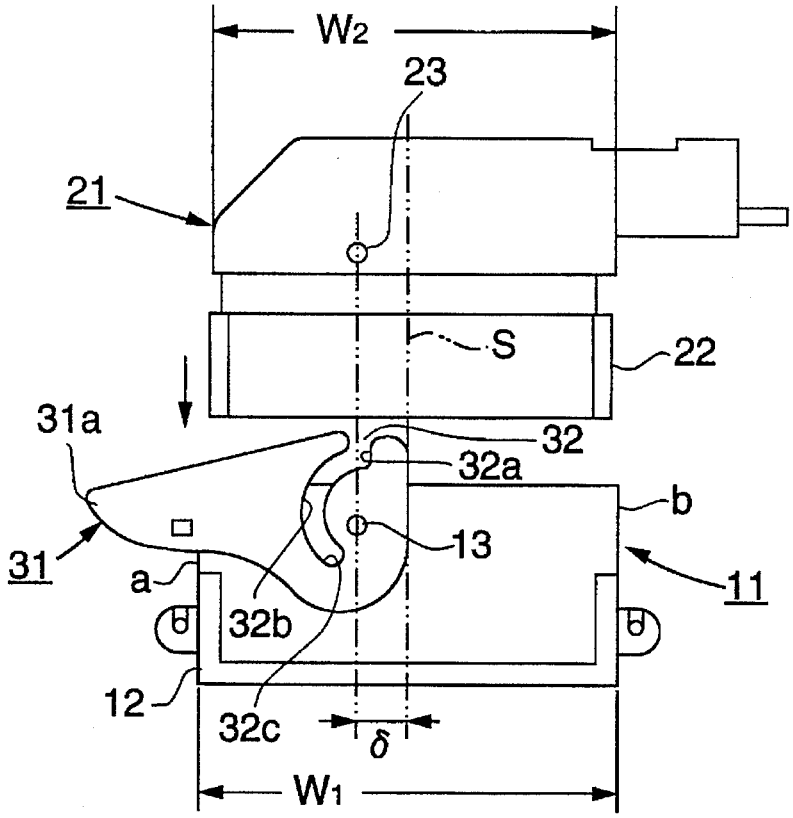
FIG. 1 is a front view typically showing an embodiment of a connector engagement device according to the present invention.

A preferred embodiment of the connector engagement device according to the present invention will be described below with reference to FIGS. 1 through 4.

FIGS. 1 through 4 are front views typically successively showing the state of connection of connectors to which the engagement device according to this embodiment is applied.

In the configurations shown in FIGS. 1 through 4, the connector engagement device of this embodiment comprises a first connector constituted by one of female and male connectors, for example, a female connector 11 in this example, and a second connector constituted by the other of the female and male connectors, that is, a male connector 21 in this example.

The female connector 11 receives a set of connection terminals (not shown) facing the connection opening end portion side of a housing portion 12 and has fulcrum axis pins 13 which are arranged in opposite sides (only one side is shown on the drawings) of the connection end portion side, and each of which is located and projected at a predetermined position biased by a predetermined bias quantity δ to the connecting operation initiating end a side from the connection-direction center line s equivalent to the substantially middle portion of the entire effective width $w_1$.

Similarly to the female connector 11, the male connector 21 receives a set of connection terminals (not shown) to be connected to the set of connection terminals of the female connector 11, which face the connection opening end portion side of a housing portion 22. The male connector 21 has a pair of engagement pins 23 which are provided on opposite sides (only one side is shown in the drawings) of the connection end portion side and each of which is located and projected at a predetermined position biased by a predetermined bias quantity δ to the connecting operation initiating end a side from the connection-direction center line s equivalent to the substantially middle portion of the entire effective width $w_2$.

According to a result of an experiment executed by the inventors of the present invention, the bias quantity δ by which the fulcrum axis pins 13 and the engagement pins 23 are biased is preferably selected to be in a range of from ⅕ to ⅖ as large as the distance between the connection-direction center line s and the connecting operation initiating end a.

Further, the operation cam lever 31 is rotatably pivotally supported on the female connector 11 so as to mount on the fulcrum axis pins 13 at opposite sides. The operation cam lever 31 is provided with cam grooves 32 which are formed so that the engagement pins 23 of the male connector 21 can be pulled to move toward the female connector 11 side in the condition that the engagement pins 23 are received in the cam grooves 32 respectively.

Quite similarly to the preliminarily described conventional case, each of the cam grooves 32 on the opposite sides of the operation cam lever 31 is composed of a lead-in opening portion **32*a*, a guide cam groove portion 32*b*, and a locking groove portion 32*c*. The lead-in opening portion 32*a* is designed to be able to receive a corresponding engagement pin 23 of the male connector 21 without any stress in the open position of the operation cam lever 31 where the operation cam lever 31 is rotated around the pivot point in the condition that the pivot hole (reference numeral is not given for the sake of simplification) for the operation cam lever 31 is fitted to the fulcrum axis pin 13 of the female connector 11. The guide cam groove portion 32*b* is connected to the lead-in opening portion 32*a* and designed to be able to pull the engagement pin 23 toward the pivot point gradually. The locking groove portion 32*c* is connected to the guide cam groove portion 32*b* and designed to be able to lock/hold the engagement pin 23**.

Figure 2:
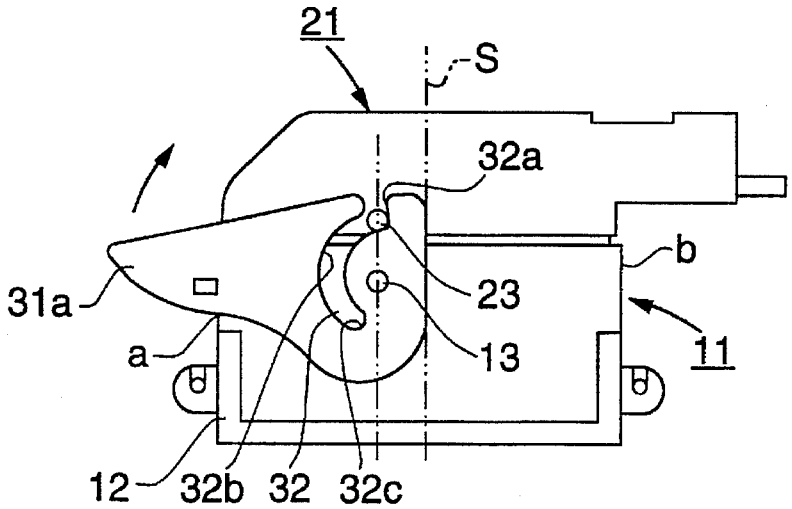
FIG. 2 is a front view typically showing the state of preparation of connection of the connectors depicted in FIG. 1.

Accordingly, in the connector engagement device of this embodiment configured as described above, when the set of connection terminals of the male connector 21 are first temporarily connected respectively correspondingly to the set of connection terminals of the female connector 11 by shallow insertion of the male connector 21 into the female connector 11 in a state (FIG. 1) in which the connection opening end portion of the male connector 21 is put so as to face the connection opening end portion of the female connector 11, the engagement pins 23 on the opposite sides of the male connector 21 are led respectively correspondingly into the lead-in opening portions **32*a* on the opposite sides of the operation cam lever 31 which is held in the open position in a state where the operation cam lever 31 is pivotally supported on the female connector 11 (FIG. 2**).

In the aforementioned condition, next, when the female connector 11 side operation cam lever 31 is rotated from the connecting operation initiating end a side to the connecting operation terminating end b side in the direction of engagement as indicated by the arrow, the following operation is effected because the respective set positions of the fulcrum axis pins 13 for the operation cam lever 31 and of the engagement pins 23 are biased by a predetermined bias quantity δ to the connecting operation initiating end a side from the connection-direction center lines s.

Figure 3:
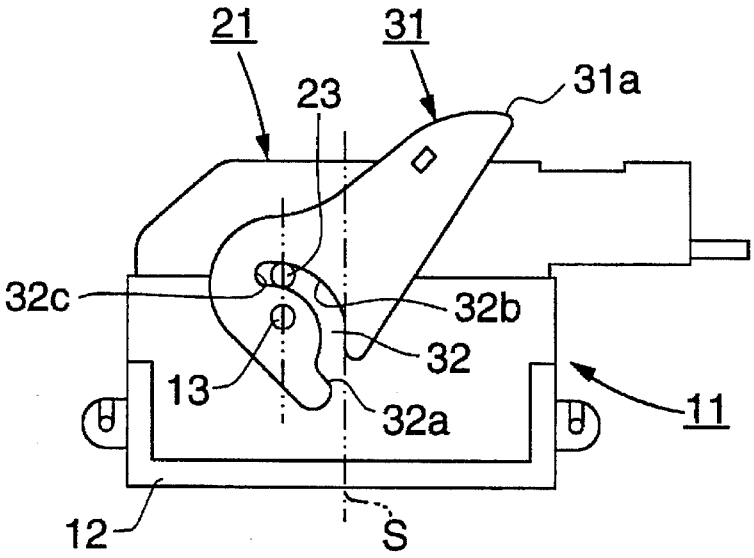
FIG. 3 is a front view typically showing the state of midway of the connecting operation of the connectors depicted in FIG. 1.

That is, the engagement pins 23 of the male connector 21 led in the respective lead-in opening portions **32*a* on the opposite sides of the operation cam lever 31 are guided while slidably contacting with groove surfaces, in the opposite sides of the fulcrum axis pins 13, of the guide cam grooves 32*b* which are formed so as to be closer to the pivot points gradually. As a result, the male connector 21 is pulled gradually to the positions of engagement with the female connector 11 by uniform or substantially uniform relatively small rotation-direction operating force because of the leverage, around the pivot points, of the guide cam groove portions 32*b* and because of the balance action due to the bias quantity δ by which the respective set positions of the fulcrum axis pins 13 and the engagement pins 23 are biased to the connecting operation initiating end a side from the connection-direction center lines s. Thus, the set of connection terminals of the male connector 21 is connected gradually deeply to the set of connection terminals of the female connector 11. When the engagement pins 23 reach the terminating ends of the guide cam groove portions 32*b*, the two sets of connection terminals of the female and male connectors 11 and 21 are connected to each other (FIG. 3**).

Figure 4:
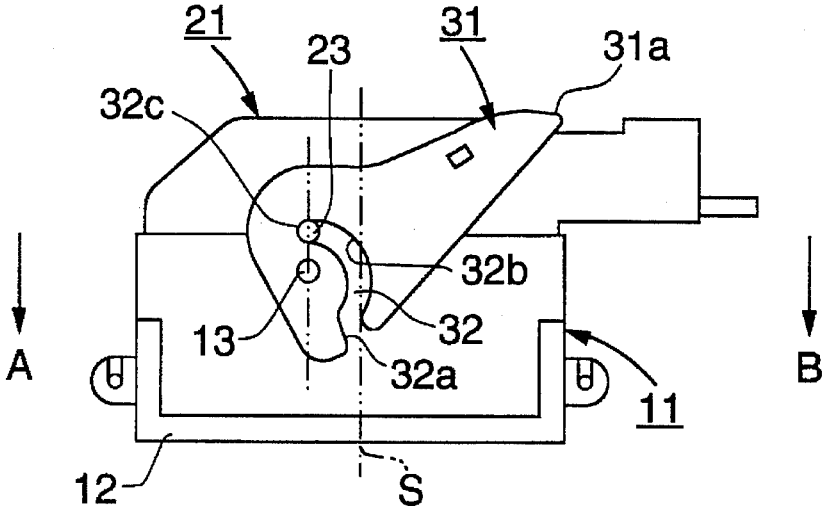
FIG. 4 is a front view typically showing the state of completion of the connection of the connectors depicted in FIG. 1.
Figure 5:
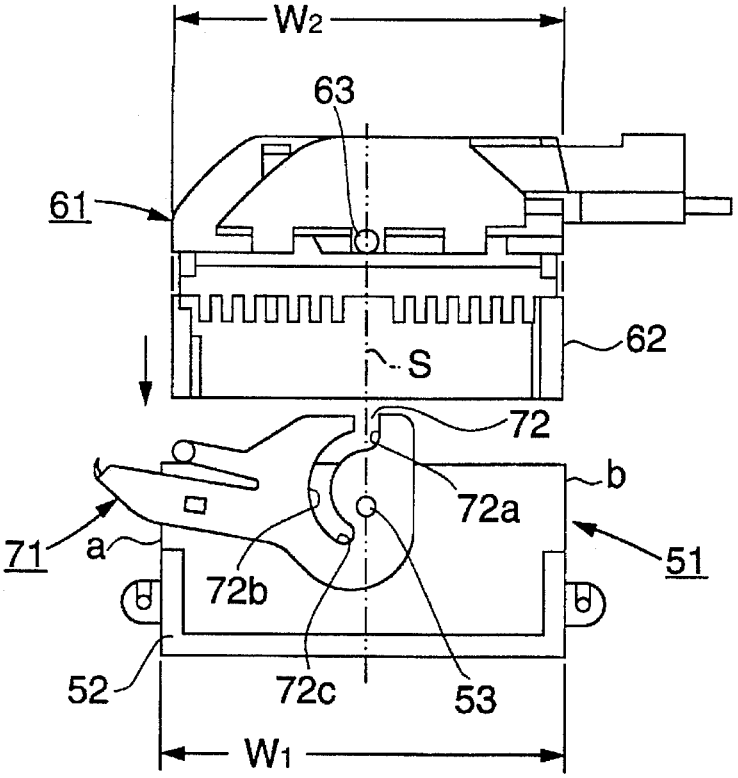
FIG. 5 is a front view typically showing a conventional connector engagement device.
Figure 6:
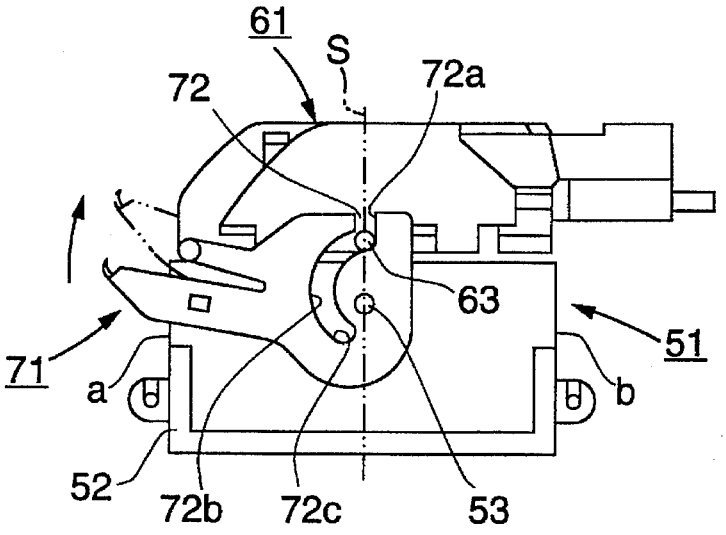
FIG. 6 is a front view typically showing the connection preparation state of the conventional engagement device.
Figure 7:
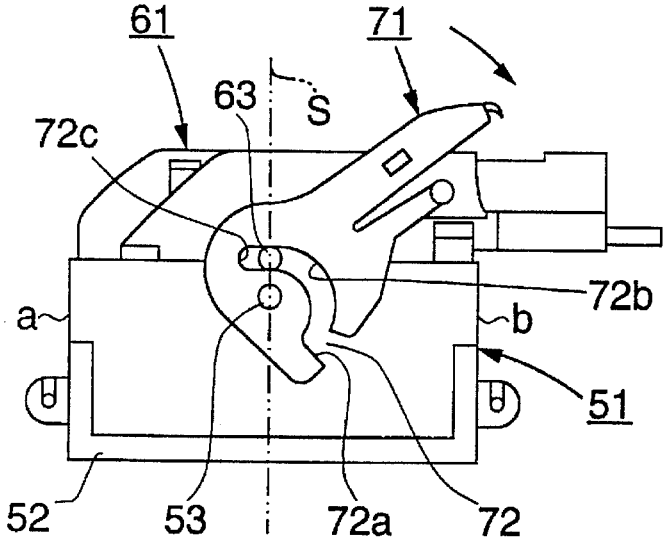
FIG. 7 is a front view typically showing the state of midway of the connecting operation of the conventional engagement device.
Figure 8:
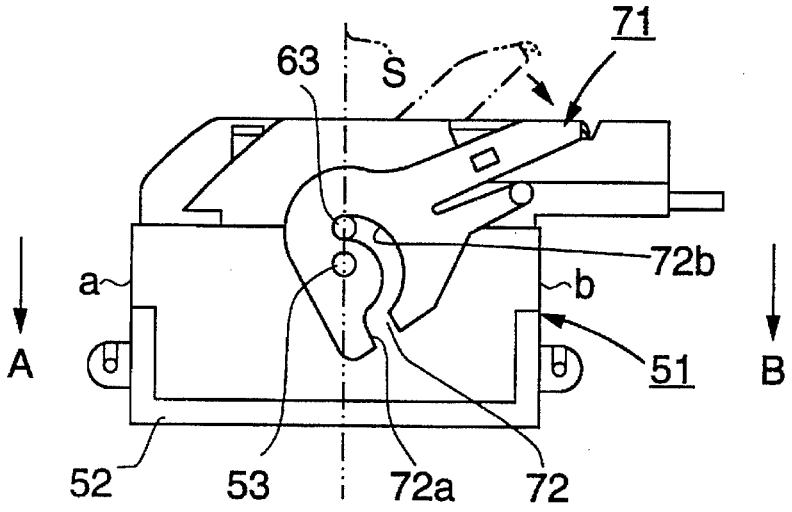
FIG. 8 is a front view typically showing the connection completion state of the conventional engagement device.

Subsequently, the rotating operation of the operation cam lever 31 in the direction of the arrow is continued so that the engagement pins 23 are received respectively in the locking groove portions **32*c*, and the connection of the sets of connection terminals of the male and female connectors 21 and 11 is locked. Thus, the expected connecting operation is finished (FIG. 4**).

In this case, the connecting forces acting at the time of the connecting operation are as follows. Even if the connecting forces due to groove surfaces of the cam grooves 32 of the operation cam lever 31 are unilaterally given, in the late stage of the connecting operation, to the engagement pins 23 in the direction from the connecting operation terminating end b side to the connecting operation initiating end a side as described preliminarily, the connecting force A on the connecting operation initiating end a side and the connecting force B on the connecting operation terminating end b side are made substantially equal to each other so that the connectors are fitted to each other in equilibrium or substantially in equilibrium because the fulcrum axis pins 13 of the operation cam lever 31 and the engagement pins 23 of the male connector 21 are biased by a predetermined bias quantity δ to the connecting operation initiating end a side from the connection-direction center lines s.

Incidentally, the locked state of connection is unlocked easily by reversely effecting the aforementioned operation. Accordingly, in the case of the configuration of the aforementioned embodiment, the engagement pins 23 of the male connector 21 are attracted to the female connector 11 side by the cam operation of the cam grooves 32, particularly of the guide cam groove portions **32*b***, as the operation cam lever 31 is operated to rotate from the connecting operation initiating end a side to the connecting operation terminating end b side. Further, because the respective set positions of the fulcrum axis pins 13 for the operation cam lever 31 and of the engagement pins 23 are biased by a predetermined bias quantity δ to the connecting operation initiating end a side from the connection-direction center lines s, not only can the connection of the set of connection terminals of the male connector 21 into the set of connection terminals of the female connector 11 be performed with uniform or substantially uniform connecting pressure, but the connecting forces A and B acting on the connecting operation initiating end a side and the connecting operation terminating end b side, respectively, can be made in equilibrium or substantially in equilibrium. Accordingly, one of the connector front side and the connector rear side can be prevented from floating up relative to the other unlike in the conventional case described preliminarily. Thus, a continuously good and effective connection state can be provided.

Although the aforementioned embodiment has shown the case where operation cam lever and engagement pins are arranged on the female connector side and on the male connector side, respectively, it is a matter of course that this relation is relative and that the invention is not always limited to the aforementioned embodiment. For example, the same operation/effect can be obtained even in the case where the operation cam lever and the engagement pins are reversely arranged on the male connector side and on the female connector side, respectively. Although the configuration of the aforementioned embodiment has shown the case where the respective set positions of the fulcrum a fulcrum axis pins for pivotally supporting the operation cam lever of the female connector and the engagement pins of the male connector are set so as to be biased by a predetermined bias quantity to the connecting operation initiating end side from the connection-direction center lines at the connection ends of the respective connectors, the same operation/effect can be obtained even in the case where at least the fulcrum axis pins or the engagement pins are set so as to be biased.

As described above, in accordance with the present invention, the following effect is obtained because the set position of at least the fulcrum axis pins for the operation cam lever pivotally supported on the first connector or the engagement pins arranged on the second connector so as to be project are biased by a predetermined bias quantity to the connecting operation initiating end side from the connection-direction center lines at the connection ends of the respective connectors.

That is, not only the connecting forces of the first and second connectors due to the rotation of the operation cam lever act uniformly or substantially uniformly from the connecting operation initiating point of time to the connecting operation terminating point of time but also the connection of the first and second connectors can be performed easily using a small insertion/removal force. Further, the connectors are connected to each other in equilibrium or substantially in equilibrium, so that a good fitting state can be obtained.

What is claimed is:

1. A connector engagement device comprising:

fulcrum axis pins formed on opposite sides of a first connector of one of male and female connectors, respectively;

an operation cam lever mounted on said first connector and rotatably pivotally supported on said fulcrum axis pins, said operation cam lever having cam grooves formed in opposite sides of said cam lever, respectively; and engagement pins formed so as to project respectively from opposite sides of a second connector of the other of said female and male connectors, said engagement pins being engageable with said cam grooves respectively so that said engagement pins are urged through said cam grooves toward said first connector as said operation cam lever is operated to rotate from a connecting operation initiating end side to a connecting operation terminating end side to thereby perform mutual connection of a first set of connection terminals facing a connection opening end portion of said first connector to a second set of connection terminals facing a connection opening end portion of said second connector;

wherein a set position of at least one of said fulcrum axis pins and said engagement pins is biased toward said connecting operation initiating end side from a connection-direction center line of said connection opening end portion of each of said connectors, said set position being biased by a bias quantity within a range of from ⅕ to ⅖ as large as a distance between said connection-direction center line and said connecting operation initiating end side.

* * * * *